United States Patent [19]

Szego

[11] 4,249,669

[45] Feb. 10, 1981

[54] CONTAINERS AND OTHER LIQUID-HOLDING MEANS

[75] Inventor: Andrew Szego, Willowdale, Canada

[73] Assignee: Explosafe America Inc., Rexdale, Canada

[21] Appl. No.: 91,713

[22] Filed: Nov. 6, 1979

[30] Foreign Application Priority Data

Nov. 9, 1978 [GB] United Kingdom ..... 43906/78

[51] Int. Cl.[3] ..... B65D 88/34; B65D 87/48

[52] U.S. Cl. ..... 220/216; 220/88 A

[58] Field of Search ..... 220/216, 219, 227, 88 A

[56] References Cited

U.S. PATENT DOCUMENTS

| | | | |
|---|---|---|---|
| 3,049,261 | 8/1962 | Wade et al. | 220/216 |
| 3,356,256 | 12/1967 | Szego | 220/88 A |
| 4,149,649 | 4/1979 | Szego | 220/88 A |

FOREIGN PATENT DOCUMENTS

| | | | |
|---|---|---|---|
| 601374 | 11/1925 | France | 220/88 A |

*Primary Examiner*—George T. Hall
*Attorney, Agent, or Firm*—Ridout & Maybee

[57] ABSTRACT

A container or other liquid holding means, e.g. a pipeline, for inflammable liquids is provided with a fire-extinguishing structure. This comprises a blanket of a porous, flame-permeable, heat-resistant material, e.g. expanded metal foil, which is supported for contact with the surface of the liquid e.g. on floats embedded in the blanket, so that the blanket extends in contact with substantially the whole of the liquid surface. In the case of a pipeline, the blanket may be supported adjacent the pipeline in a normally-empty catchment facility which is intended for retaining spillages or leakages of liquid from the pipeline. The blanket has large non-capillary interstices. On ignition of the vapor/air mixture above the blanket, the flame front recedes downwardly into the blanket and the flames become extinguished. This arrangement can reduce the fire hazard associated with large-capacity containers for inflammable liquids.

21 Claims, 2 Drawing Figures

CONTAINERS AND OTHER LIQUID-HOLDING MEANS

BACKGROUND OF THE INVENTION

This invention relates to containers and other liquid-holding means for holding inflammable liquids.

In order to reduce the fire hazard associated with large-capacity storage vessels and other containers for liquid fuels e.g. oil, and gasoline, it is common practice to equip the vessels with automatically-operating fire-extinguishing apparatus. Known forms of fire-extinguishing apparatus include flame or heat sensors that detect the outbreak of fire and actuate apparatus for introducing combustion-inhibiting foams or other fire-extinguishing fluids into the interior of the container.

These arrangements are relatively complex and expensive, and they are prone to failure as they rely on the operation of relatively delicate electrical and electronic elements.

SUMMARY OF THE INVENTION

The present invention provides a container for inflammable liquids having an upwardly extending sidewall, a body of inflammable liquid held within the container, and a fire-extinguishing structure comprising a porous blanket extending over substantially the whole of the surface of the liquid in the container, said blanket being of heat-resistant expanded metal foil material comprising interconnected flat mesh strands defining diamond-shaped openings having interstices of non-capillary size that are sufficiently large that they permit a flame front to propagate through the blanket and means supporting said blanket in contact with said liquid and in close abutment with the container sidewall, and with a thickness of the blanket material extending above the liquid surface sufficient to suppress combustion of the liquid at its surface.

The blanket has interstices sufficiently large to permit propagation of flame through it, i.e. it is flame-permeable, and is formed of sufficient thickness that the flames tend to become smothered as they penetrate downwardly through the blanket towards the liquid surface.

In contrast to flame arrestor materials, flame-permeable materials permit the propagation of a flame front through them when they are exposed to an ignited combustible air and vapour mixture. One advantage of the flame-permeable materials is that they are normally of comparatively low density as compared with flame arrestor materials and they are therefore somewhat less expensive than the flame arrestor materials, as well as being easier to support within the container.

The fire-extinguishing action of the flame-permeable material employed in the present invention results from the flame front receding downwardly into the fire-extinguishing blanket as the fuel vapour existing in the space above the surface of the blanket is consumed. After a certain time, even when air is freely available to the flames on the surface of the blanket, the flames die down and gradually become extinguished. Without wishing to be bound to any theory, it appears this is because inert gaseous combustion products tend to be retained in the interstices of the blanket and serve to restrict the access of oxygen to the flames.

The thickness of blanket exposed above the level of the liquid surface that is required to provide a satisfactory fire-extinguishing action depends on the pore size of the blanket as well as on the flash point of the inflammable liquid. The larger the pore size of the material of the blanket, and the lower the flash point of the inflammable liquid concerned, the greater is the required thickness of blanket.

One especially preferred form of expanded metal foil material for use in the present invention is the aluminium foil material described in U.S. Pat. No. 4,149,649 dated Apr. 17, 1979 in the name Andrew Szego, or in U.S. Pat. No. 3,356,256 dated Dec. 5, 1967 in the name Joseph Szego, especially with reference to FIG. 9 thereof. This material is available under the trade mark EXPLOSAFE from the Explosafe Division of Vulcan Industrial Packaging Limited, Rexdale, Ontario, Canada. This material is formed from a plurality of layers, each comprising a layer of expanded metal foil consisting of inter-connected flat mesh strands which are each inclined at the same angle to the general plane of the layer, and which define between them diamond shaped openings. As commercially available this material has pores or interstices of relatively large size and is flame permeable. The interstices exhibit no capillary action, and therefore there is no capillary attraction of the liquid through the blanket, so that the upper level of the blanket does not become wetted with the inflammable liquid. Moreover, the aluminium foil is flame and heat resistant, and is relatively light in weight, and due to the porosity of the blanket, it does not interfere with the free evolution of vapour from the surface of liquid during the normal use of the storage vessel.

The present invention also provides in combination, liquid-holding means extending above the surface of the ground and normally containing an inflammable liquid, a normally empty catchment facility comprising a raised retaining wall extending adjacent the liquid-holding means for retaining the liquid contents of the liquid-holding means in the event of rupture of the liquid-holding means, and including a fire-extinguishing structure comprising a blanket of heat-resistant porous material having non-capillary interstices sufficiently large to permit propagation of a flame through the blanket, and means supporting the blanket within the catchment facility for contact with the inflammable liquid when received therein and with a thickness of the blanket material extending above the surface of the liquid when received therein sufficient to suppress combustion of the liquid at its surface.

In fuel storage tank farms, it is conventional to surround each tank by a spillage-retaining wall which forms a catchment facility of capacity sufficient to retain the entire contents of the tank in the event of rupture of the tank. Moreover, in such farms, or in refineries or other processing plants handling inflammable liquids there may be pipelines, conduits, and other piping that holds inflammable liquids and these may be surrounded by similar retaining walls for holding spillages of inflammable liquids. Depending on the amount of spillage, these catchment facilities may become filled with a considerable depth of flammable fuel or other liquid, or may contain pools of rain water of considerable depth, which, when a layer of flammable fuel is floating on the surface of the water, are a serious hazard to the safety of fire-preventative or fire-fighting crews seeking to traverse the catchment facility to reach for example valving or ruptured piping or some other source of leakage of the contents of fuel or other inflammable liquid.

With the above arrangement, the fire-extinguishing structure can serve to extinguish any outbreaks of fire that may occur in the catchment facility if the fuel or other liquid in the catchment facility becomes ignited. The fire-extinguishing blanket may comprise the above-mentioned EXPLOSAFE expanded metal foil material.

Similar porous heat-resistant blanket materials that may be employed include materials of honeycomb sandwich construction, e.g. the metal honeycomb materials available under the trade mark HEXCEL, from Hexcel Corporation, Dublin, California, and knitted wire mesh products, as available under the trade mark METEX from Metex Corporation, Edison, New Jersey. Coherent woven, non-woven, or knitted blankets formed from inorganic filamentary materials, e.g. rock wools may also be employed. It is however preferred to employ metallic, heat-conductive materials, as the heat-dissipating capacities of the conductive blankets can enhance the flame-extinguishing effect.

Examples of other blanket materials that may be flame-permeable depending on the pore size include fire-retardant polyurethane foams having large, non-capillary, open cells, the metal-plated plastics foams available under the trade mark RETIMET from Dunlop Limited, England, and ceramic foam such as the continuous open pore ceramic foam material available under the trade mark SELEE from Consolidated Aluminum Corporation.

In use, it is important that the blanket should be maintained in contact with the liquid surface, so that there are no gaps between the liquid and the blanket at which flames may persist. In the preferred form the blanket is floated or adapted to float on the surface of the liquid by supporting the blanket on floats having buoyancy selected so that the lower side of the blanket is immersed in the liquid and a sufficient fire-extinguishing thickness of blanket is exposed above the liquid surface. Where there are only relatively small variations in the liquid level in use, it may be possible to employ a limited thickness of the blanket material mounted on stationary supports within the container or within the normally empty catchment facility.

There are known kinds of liquid fuel storage vessels having floating roofs that are supported on pontoons or on other support arrangements so that the roof moves up and down as the vessel is filled and emptied. These storage vessels may be provided with fire-extinguishing structures in accordance with the invention by attaching the fire-extinguishing blanket to the lower side of the floating roof structure, with the lower side of the blanket being immersed in the liquid and the blanket occupying the gas space existing between the roof structure and the liquid surface.

DESCRIPTION OF THE PREFERRED EMBODIMENTS

Figure 1:
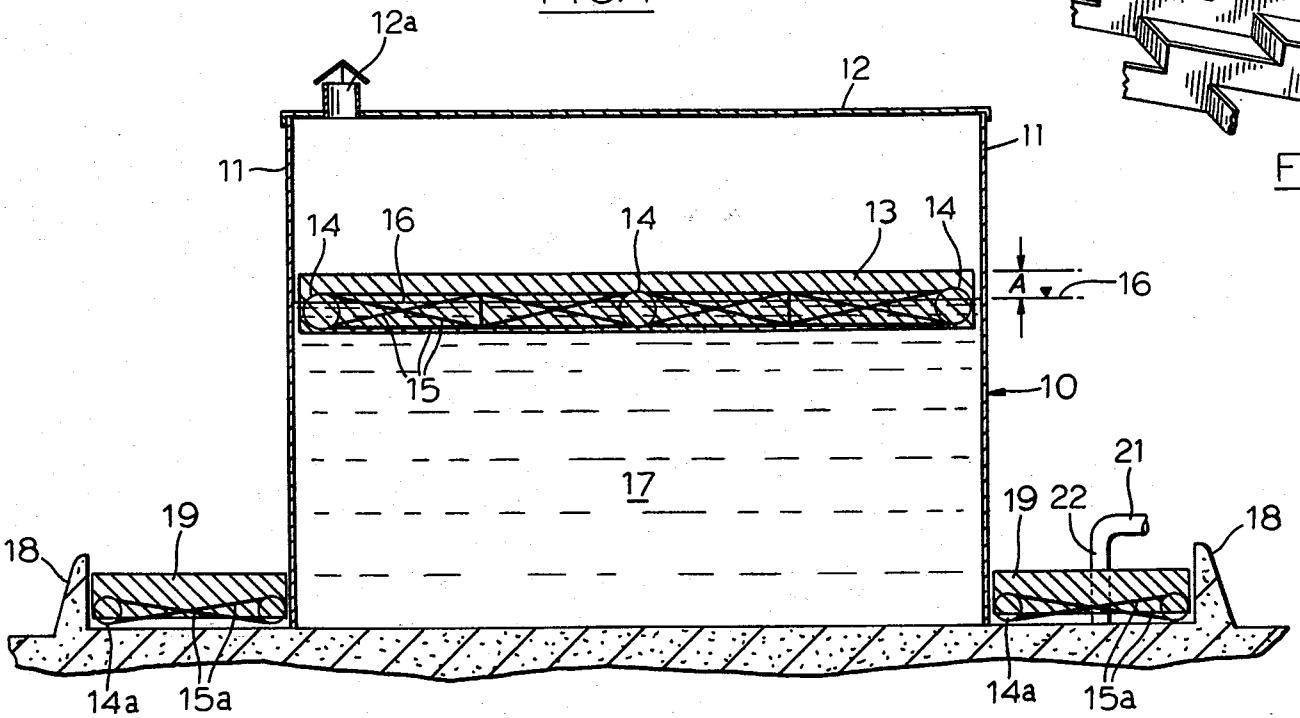
FIG. 1 illustrates in diagrammatic form a fire-extinguishing structure applied to a storage vessel having a fixed roof and also a fire-extinguishing structure applied to a spillage-retaining catchment facility surrounding the vessel.

Referring to FIG. 1, a conventional storage tank 10 for liquid fuels, has side walls 11 and a roof 12. The tank is vented e.g. as indicated schematically with a vent 12*a* so that there is communication between the ambient atmosphere and the upper interior of the tank to permit air to enter or be displaced when the tank is emptied or filled. Particularly when liquid is being drawn from the tank, a combustible air/vapor mixture can exist within the space above the surface level 16 of the liquid 17 in the tank. A fire-extinguishing structure is provided in the form of a blanket 13 floating within the tank and composed of a plurality of layers of the EXPLOSAFE (trade mark) expanded foil material described in the above-mentioned U.S. Pat. No. 4,149,649.

Figure 2:
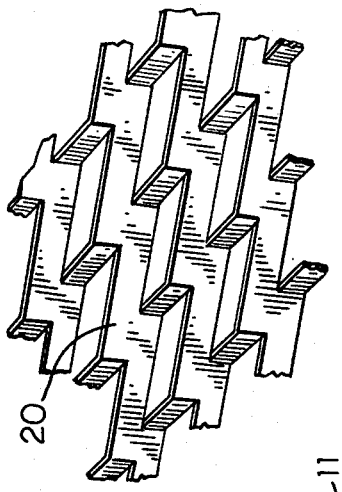
FIG. 2 is a perspective view of a web of expanded metal foil material.

As discussed in more detail in the aforesaid patent, and as illustrated in FIG. 2, this material comprises a web of interconnected flat mesh strands 20 which define diamond-shaped openings. Each strand 20 is inclined at the same angle to the general plane of the web. A plurality of these webs can be laid one on top of another to form the multiple-layer blanket 13.

The blanket 13 is supported on buoyant pontoons 14 embedded within the blanket. The pontoons 14 are linked together and to the blanket 13 by cross-bracing struts 15. The buoyancy of the pontoons 14 is such that the lower levels of the blanket 13 are partially immersed in the liquid fuel 17 contained within the tank 10, and a predetermined thickness of the blanket extends upwardly above the level of the surface 16 of the liquid 17 in the tank. By arranging the pontoons 14 or other flotation means so that they are at least partially embedded within the porous blanket 13, the blanket 13 can extend continuously across substantially the whole of the liquid surface 16.

In operation, this arrangement can reduce any fire hazard which may arise from ignition of the mixture of fuel vapour and air existing within the gas space above the liquid level 16, through the flame-extinguishing action described in more detail in the above.

By way of example, it may be mentioned that a flame-extinguishing action, capable of extinguishing flames from a medium or low flash point liquid e.g. motor vehicle gasoline can be obtained with a minimum thickness of EXPLOSAFE (trade mark) expanded foil existing above the liquid level 16, as indicated by the dimension A in the accompanying drawings of about 10 cm. It is preferred to employ thicknesses somewhat greater than the experimentally-determined minimum, so as to allow a safety margin. Preferably, therefore, the thickness should be at least about 25 cm inches in the case of motor vehicle gasoline and other inflammable liquids of low or medium flash point e.g. some commercial solvents. Somewhat greater thicknesses, e.g. up to about 50 cm may be desirable with inflammable liquids of very much lower flash point, e.g. jet aviation fuel such as JP 4, and with lower flash point solvents. Lesser thickness, e.g. of about 12 cm may be employable in the case of liquids of higher flash point, e.g. heavier oils. In the preferred form, in the case of liquids having a flash point of above about 30° C. (as measured by ASTM method D1310-63), the thickness of the blanket A exposed above the liquid surface is about 10 to 25 cm, and in the case of liquids having a flash point below about 30° C., the thickness A is about 25 to 50 cm.

In one form of trial for determining an appropriate thickness A for the blanket, an open-topped metal vessel may be filled with the porous material to be tested and varying quantities of the inflammable liquid are introduced into the vessel.

The vessel is equipped with a sight glass so that the depth of liquid and the thickness of the expanded foil extending above the liquid surface can be measured. The inflammable vapour at the surface of the expanded foil is ignited and the flame-extinguishing action is observed. If necessary, repeated trials can be conducted with differing thicknesses of material exposed above the liquid level so as to determine what thickness is required to give a desired short lapse of time between the ignition of the vapour and the extinguishing of the flames.

It will be appreciated that the required thickness is something that may be readily determined by trial and experiment in the case of any particular inflammable liquid and any given porous, heat-resistant blanket material.

In the example illustrated in the drawings, the tank 10 is surrounded by a conventional spillage-retaining raised wall 18, providing an open-topped catchment facility of capacity sufficient to retain the entire contents of the tank 10 in the case of rupture of the tank.

The area between the wall 18 and the tank 10 is provided with a fire-extinguishing blanket 19, similar to the blanket 13, which may be formed as a unitary annular blanket extending around the tank 10 or may be formed from a plurality of discrete blanket units, and these may likewise be supported on flotation means 14*a* and 15*a* partially embedded within the lower surface of the blanket 19 similar to the flotation means 14 and 15 employed for the main blanket 13, within the tank. As the depth of the fuel that will be retained within the wall 18 will not be very great, the blanket 19 may instead rest on the ground within the wall 18 or may be supported a small distance above the ground on fixed support legs ensuring an adequate thickness of the blanket extending above the liquid fuel surface when the catchment facility is filled with the contents of the tank. It is desirable that, in use, blankets 13 and 19 should cover substantially the whole of the inflammable liquid and conform closely to the wall of the tank 10 and to the wall 18 so that there are substantially no gaps in which flames can persist. For this reason, where the blanket 18 is mounted on flotaton means in a catchment facility, it is desirable to employ a wall 18 with a vertical inner wall, as illustrated in the drawings. The blanket 19 can of course be used in the catchment facility bounded by the wall 18 to advantage with or without the use of the blanket 13 within the storage vessel.

FIG. 1 also illustrates a portion of a pipeline 21 extending within the catchment facility. As illustrated a downwardly-extending portion 22 of the line 21 passes with a small clearance through an aperture in the blanket 19, so that in the event of leakage of inflammable liquid from the line 21 into the catchment facility, the blanket 19 may float on the surface of the collected liquid.

I claim:

1. A container for inflammable liquids having an upwardly extending sidewall, a body of inflammable liquid held within the container, and a fire-extinguishing structure comprising a porous blanket extending over substantially the whole of the surface of the liquid in the container, said blanket being of heat-resistant expanded metal foil material comprising interconnected flat mesh strands defining diamond-shaped openings having interstices of non-capillary size that are sufficiently large that they permit a flame front to propagate through the blanket and means supporting said blanket in contact with said liquid and in close abutment with the container sidewall and with a thickness of the blanket material extending above the liquid surface sufficient to suppress combustion of the liquid at its surface.

2. A container as claimed in claim 1 wherein the blanket material comprises a plurality of layers of expanded metal foil.

3. A container as claimed in claim 1 wherein the metal foil material comprises webs wherein each mesh strand is inclined at the same angle to the general plane of the web.

4. A container as claimed in claim 1 wherein the blanket material comprises expanded aluminium foil.

5. A container as claimed in claim 1 wherein said blanket is supported with a thickness of from about 10 cm to about 50 cm of the blanket material extending above the surface of the liquid.

6. A container as claimed in claim 5 wherein the liquid has its flash point above about 30° C. and the thickness of blanket material exposed above the liquid surface is about 10 to 25 cm.

7. A container as claimed in claim 5 wherein the liquid has its flash point below about 30° C. and the thickness of the blanket material exposed above the liquid surface is about 25 to 50 cm.

8. A container as claimed in claim 1 wherein said supporting means comprise flotation means and said blanket floats on the liquid surface.

9. A container as claimed in claim 8 wherein said blanket extends continuously over substantially the whole of the surface of liquid in the container.

10. A container as claimed in claim 9 wherein the flotation means comprise floats at least partially embedded within the continuous blanket.

11. In combination, liquid-holding means extending above the surface of the ground and normally containing an inflammable liquid, a normally empty catchment facility comprising a raised retaining wall extending adjacent the liquid-holding means for retaining the liquid contents of the liquid-holding means in the event of rupture of the liquid-holding means, and including a fire-extinguishing structure comprising a blanket of heat-resistant porous material having non-capillary interstices sufficiently large to permit propagation of a flame through the blanket, and means supporting the blanket within the catchment facility for contact with the inflammable liquid when received therein and with a thickness of the blanket material extending above the surface of the liquid when received therein sufficient to suppress combustion of the liquid at its surface.

12. The combination as claimed in claim 11 wherein said liquid-holding means comprise pipes that convey an inflammable liquid.

13. The combination as claimed in claim 11 wherein said liquid-holding means comprise a storage tank having a side wall extending above the surface of the ground.

14. The combination as claimed in claim 11 wherein said blanket material comprises expanded metal foil material comprising interconnected flat mesh strands defining diamond-shaped openings.

15. The combination as claimed in claim 14 wherein the metal foil material comprises webs wherein each mesh strand is inclined at the same angle to the general plane of the web.

16. The combination as claimed in claim 11 wherein the blanket material comprises metal honeycomb material.

17. The combination as claimed in claim 11 wherein the blanket material comprises knitted wire mesh.

18. The combination as claimed in claim 11 wherein the blanket material comprises inorganic filamentary material.

19. The combination as claimed in claim 11 wherein the blanket material comprises an open cell plastics foam.

20. The combination as claimed in claim 19 wherein the plastics foam is metal plated.

21. The combination as claimed in claim 11, wherein the blanket material comprises a ceramic foam.

* * * * *